US008079878B2

(12) United States Patent
Huang

(10) Patent No.: US 8,079,878 B2
(45) Date of Patent: Dec. 20, 2011

(54) COMBINATION ELECTRIC PLUG ASSEMBLY

(75) Inventor: Tzi-Chen Huang, Tao-Yuan Hsien (TW)

(73) Assignee: I Sheng Electric Wire & Cable Co. Ltd., Tao-Yuan Hsien (TW)

( * ) Notice: Subject to any disclaimer, the term of this patent is extended or adjusted under 35 U.S.C. 154(b) by 0 days.

(21) Appl. No.: 12/242,929

(22) Filed: Oct. 1, 2008

(65) Prior Publication Data

US 2011/0136389 A1 Jun. 9, 2011

(51) Int. Cl.
*H01R 24/00* (2006.01)

(52) U.S. Cl. ..... 439/660; 439/692

(58) Field of Classification Search ..... 439/660, 439/108, 692, 695

See application file for complete search history.

(56) References Cited

U.S. PATENT DOCUMENTS

| | | | | |
|---|---|---|---|---|
| 6,685,486 | B1 * | 2/2004 | Zhang et al. | 439/79 |
| 7,318,752 | B2 * | 1/2008 | Fujimoto et al. | 439/660 |
| 7,467,977 | B1 * | 12/2008 | Yi et al. | 439/607.01 |
| 2005/0048846 | A1 * | 3/2005 | Suzuki et al. | 439/660 |

* cited by examiner

*Primary Examiner* — Xuong Chung Trans

(57) ABSTRACT

A combination electric plug assembly includes an electric plug, which has an electrically insulative housing defining a front receiving chamber and a set of power terminals and a set of signal terminals mounted in the front receiving chamber, and an adapter which has an electrically insulative housing defining a receiving chamber for receiving the electrically insulative housing of the electric plug, an electrically insulative core member suspending in the electrically insulative housing and insertable into the front receiving chamber of the electric plug, and a set of terminal power terminals and a set of signal terminals respectively mounted in the electrically insulative core member and respectively soldered to a circuit board of an electronic apparatus for the contact of the power terminals and signal terminals of the electric plug for transmitting power supply and signal at the same time.

10 Claims, 6 Drawing Sheets

COMBINATION ELECTRIC PLUG ASSEMBLY

BACKGROUND OF THE INVENTION

1. Field of the Invention

The present invention relates to electric plugs and more particularly, to a combination electric plug assembly adapted for transmitting power supply and signal at the same time.

2. Description of the Related Art

Following fast development of electronic technology, many advanced electronic products have been created and are intensively used in our daily life. To enhance the function for versatile applications, an electronic product generally has a number of electric connectors for connection to a remote host through one or a number of transmission lines for transmitting different signals. Further, an electronic product usually uses a power cable for obtaining the necessary working voltage from an external power source. When many signal and power connectors are installed in a circuit board, it is difficult to achieve the design having light, thin, short and small characteristics.

SUMMARY OF THE INVENTION

The present invention has been accomplished under the circumstances in view. It is one object of the present invention to provide a combination electric plug assembly, which is adapted for transmitting power supply and signal at the same time. It is another object of the present invention to provide a combination electric plug assembly, which is adapted for use in a low-profile electronic product having light, thin, short and small characteristics for transmitting power supply and signal at the same time.

To achieve these and other objects of the present invention, the combination electric plug assembly comprises an electric plug, and an adapter adapted for electrically connecting the electric plug to the circuit board of an electronic product. The electric plug comprises an electrically insulative housing, which defines a front receiving chamber in the front side thereof, a set of power terminals mounted in a bottom side inside the front receiving chamber, and a set of signal terminals mounted in the electrically insulative housing and respectively partially suspending in the front receiving chamber. The adapter comprises an electrically insulative housing, which defines a receiving chamber adapted for receiving the electrically insulative housing of the electric plug, an electrically insulative core member suspending in the receiving chamber and insertable into the front receiving chamber of the electrically insulative housing of the electric plug, a plurality of terminal slots formed in the electrically insulative core member, a plurality of power terminals respectively mounted in the terminal slots for the contact of the power terminals of the electric plug respectively, and a set of signal terminals mounted on one side of the electrically insulative core member for the contact of the signal terminals of the electric plug respectively.

DETAILED DESCRIPTION OF THE PREFERRED EMBODIMENT

Figure 1:
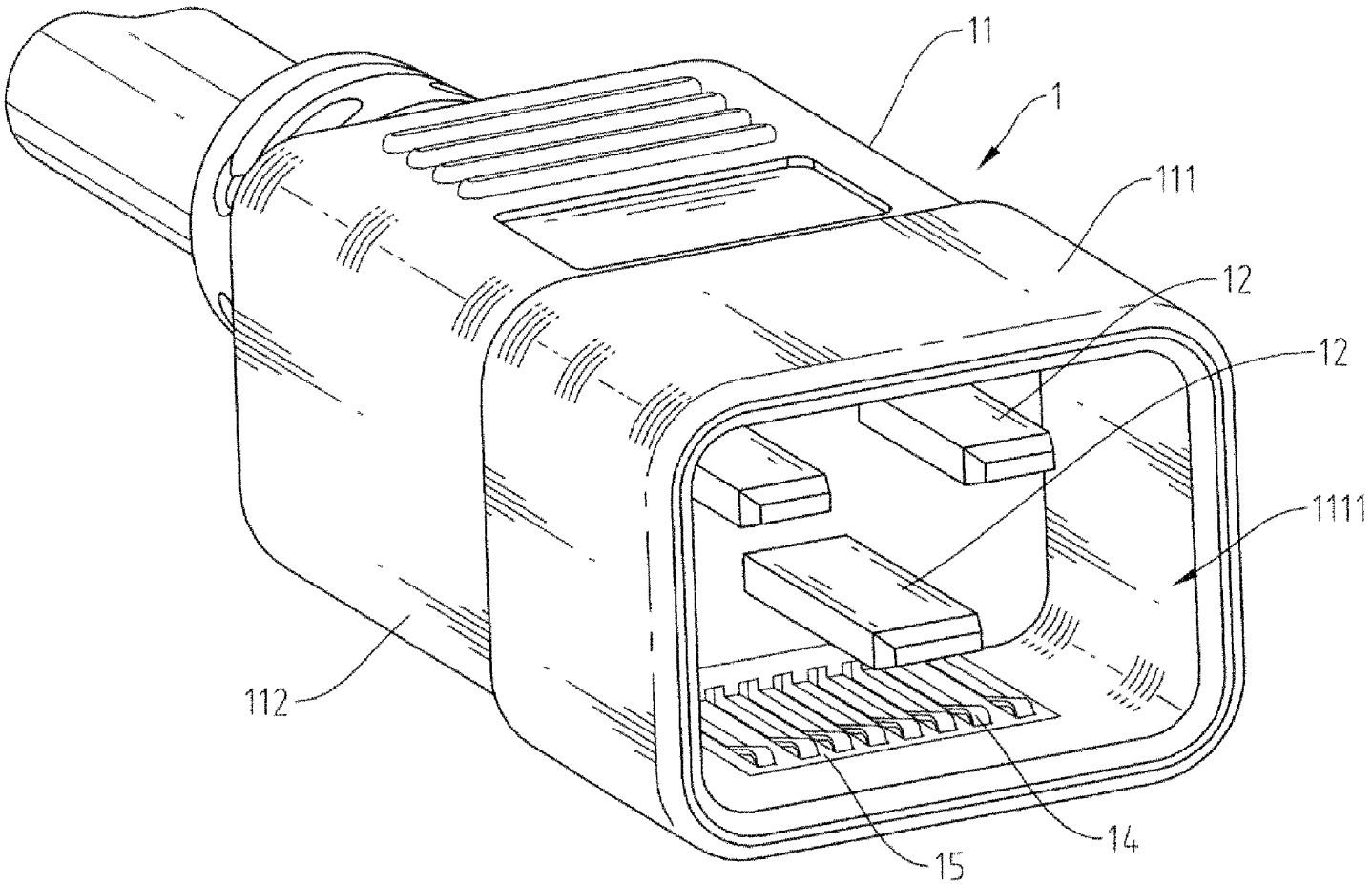
FIG. 1 is an elevational view of an electric plug for combination electric plug assembly according to the present invention.
Figure 2:
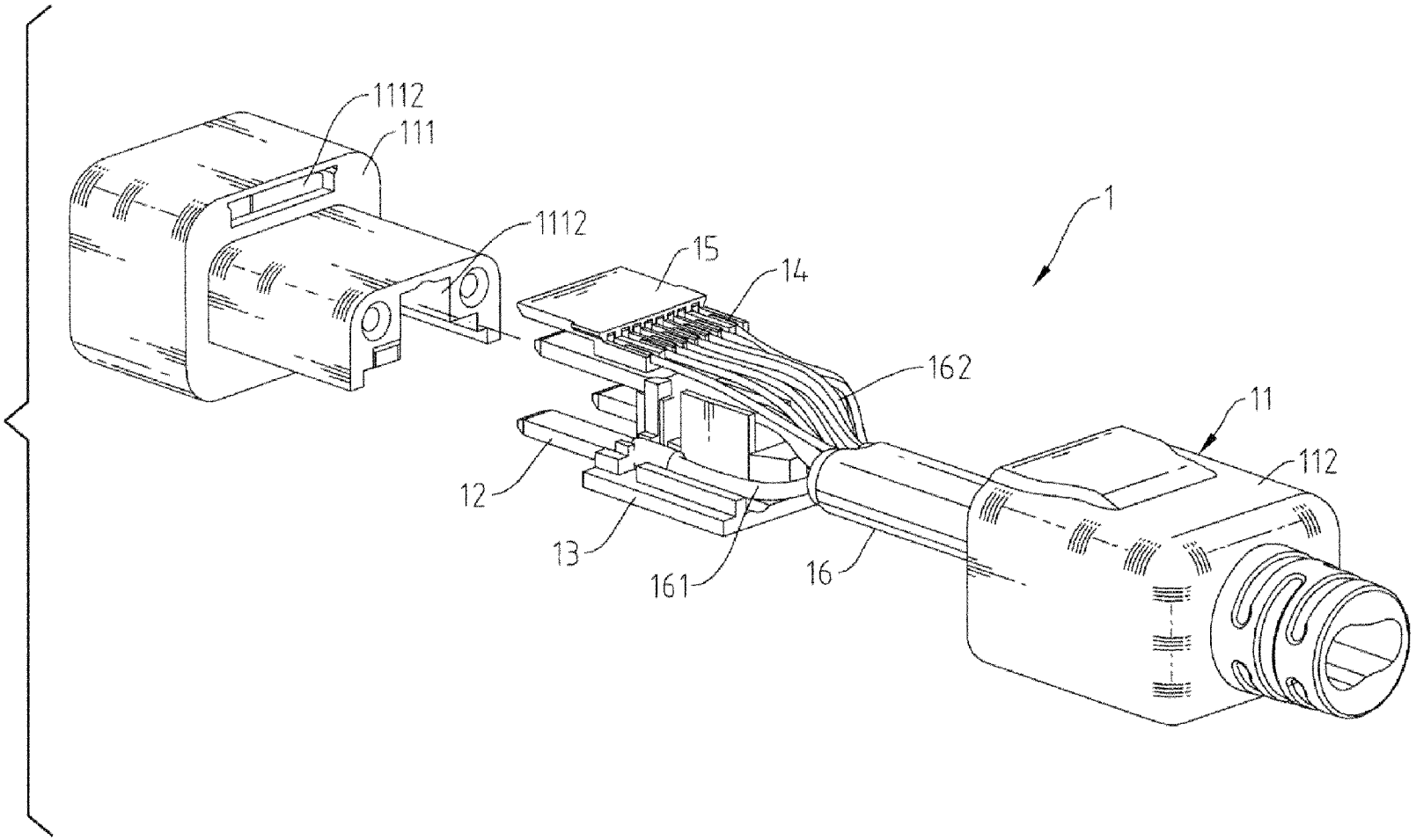
FIG. 2 is an exploded view of the electric plug for combination electric plug assembly according to the present invention.
Figure 3:
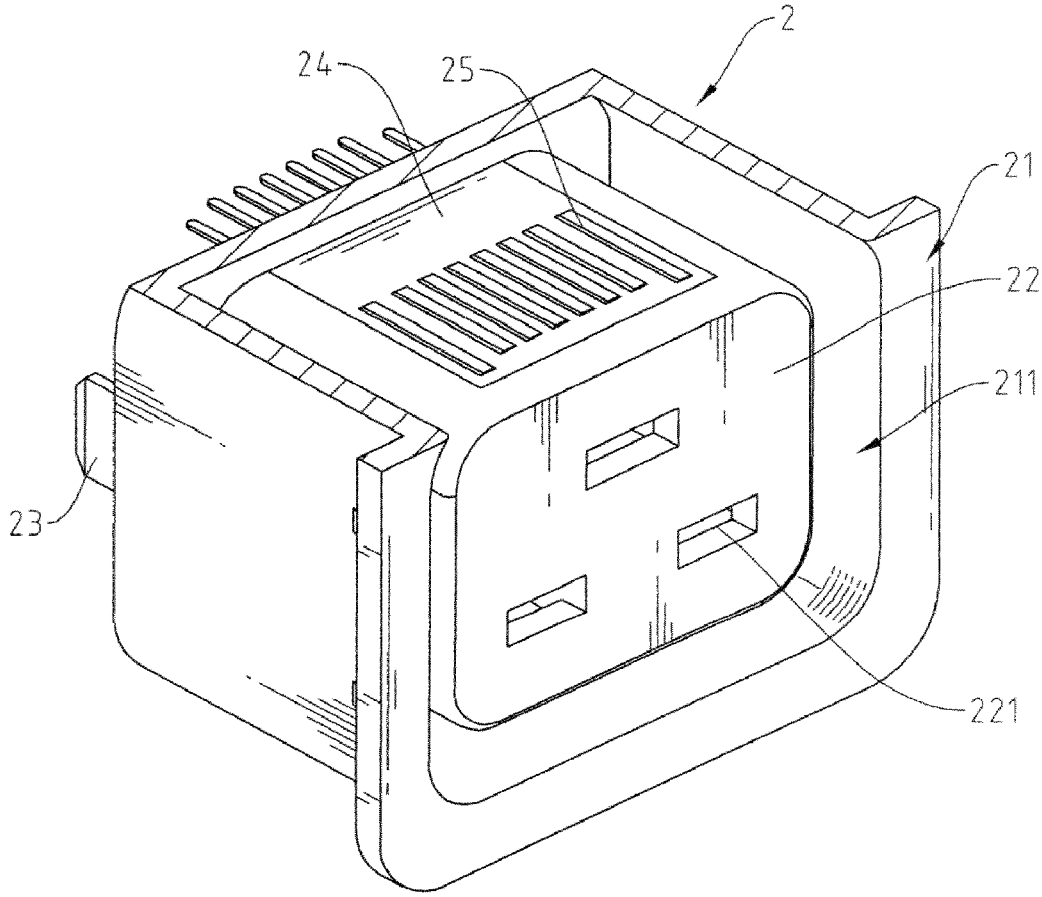
FIG. 3 is a cutaway view of an adapter for combination electric plug assembly according to the present invention.
Figure 4:
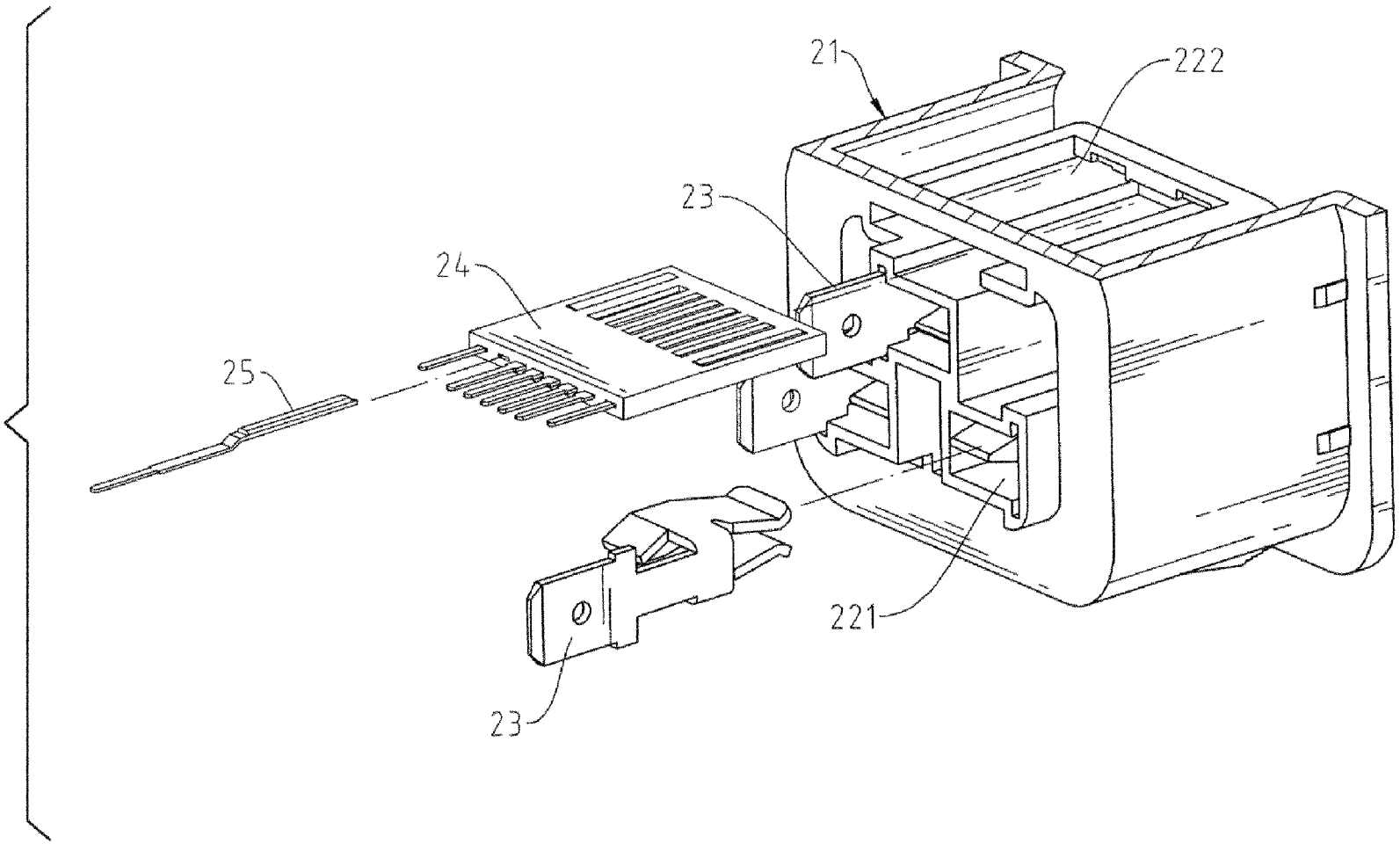
FIG. 4 is an exploded view of the adapter for combination electric plug assembly according to the present invention.

Referring to FIGS. 1~4, a combination electric plug assembly in accordance with the present invention is shown comprised of an electric plug 1 and an adapter 2.

The electric plug 1 comprises an electrically insulative housing 11, which is formed of a front shell 111 and a rear shell 112, a set of power terminals 12, a power terminal holder 13, a set of signal terminals 14, a signal terminal holder 15, and a transmission line 16. The front shell 111 comprises a front receiving chamber 1111 formed in the front side, and a plurality of rear openings 1112 formed in the back side in communication with the front receiving chamber 111. The power terminals 12, the power terminal holder 13, the signal terminals 14, the signal terminal holder 15 and the transmission line 16 are mounted in electrically insulative housing 11. The transmission line 16 comprises a set of power transmission wires 161 and a set of signal transmission wires 162. The power terminals 12 and the signal terminals 14 are respectively mounted in the power terminal holder 13 and the terminal holder 15, and respectively electrically connected with the power transmission wires 161 and the signal transmission wires 162. The power terminal holder 13 and the terminal holder 15 are respectively inserted into the rear openings 1112 of the front shell 111 to hold the signal terminals 14 in the bottom side inside the front receiving chamber 1111 and to suspend the power terminals 12 in the front receiving chamber 1111. Further, the rear end of the transmission line 16 extends out of the rear side of the rear shell 112 of the housing 11.

The adapter 2 comprises an electrically insulative housing 21 defining a receiving chamber 211, an electrically insulative core member 22 suspending in the receiving chamber 211, a plurality of terminal slots 221 formed in the electrically insulative core member 22, a plurality of power terminals 23 respectively mounted in the terminal slots 221, a mounting groove 222 formed on one side of the electrically insulative core member 22 in communication with the receiving chamber 211, a signal terminal holder 24 mounted in the mounting groove 222, and a plurality of signal terminals 25 mounted in the signal terminal holder 24.

Figure 5:
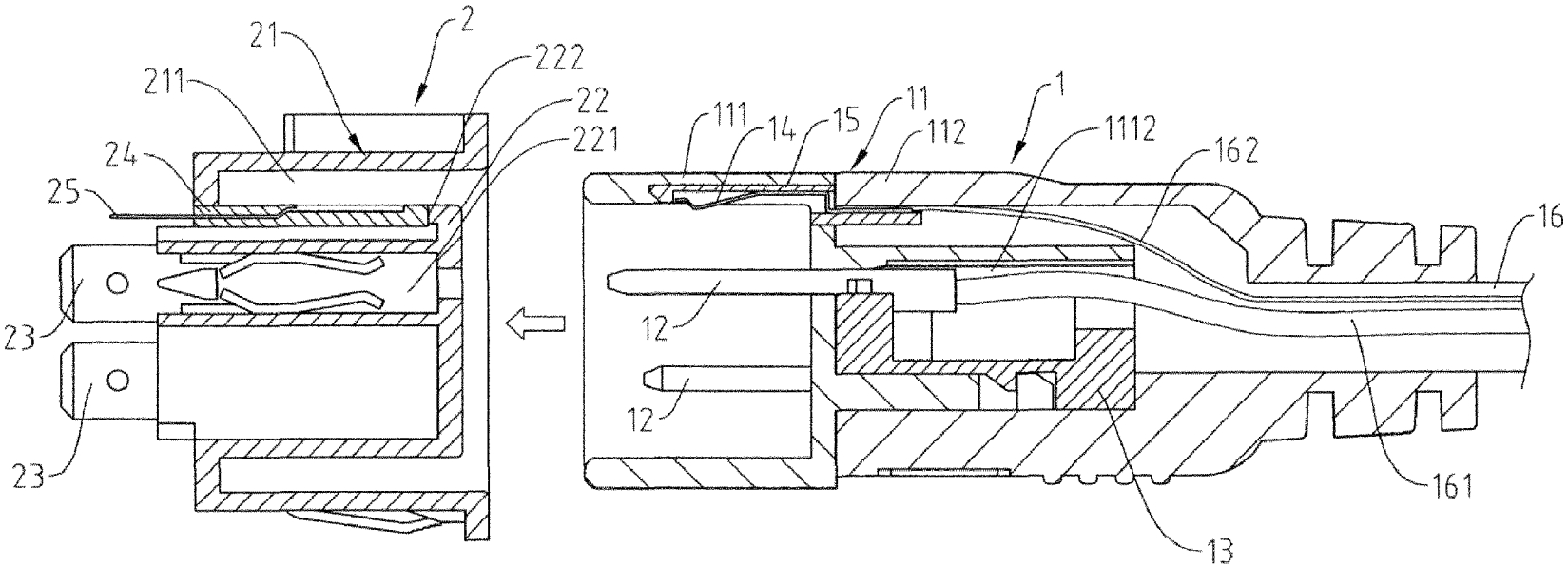
FIG. 5 is a sectional exploded side view of the combination electric plug assembly according to the present invention.
Figure 6:
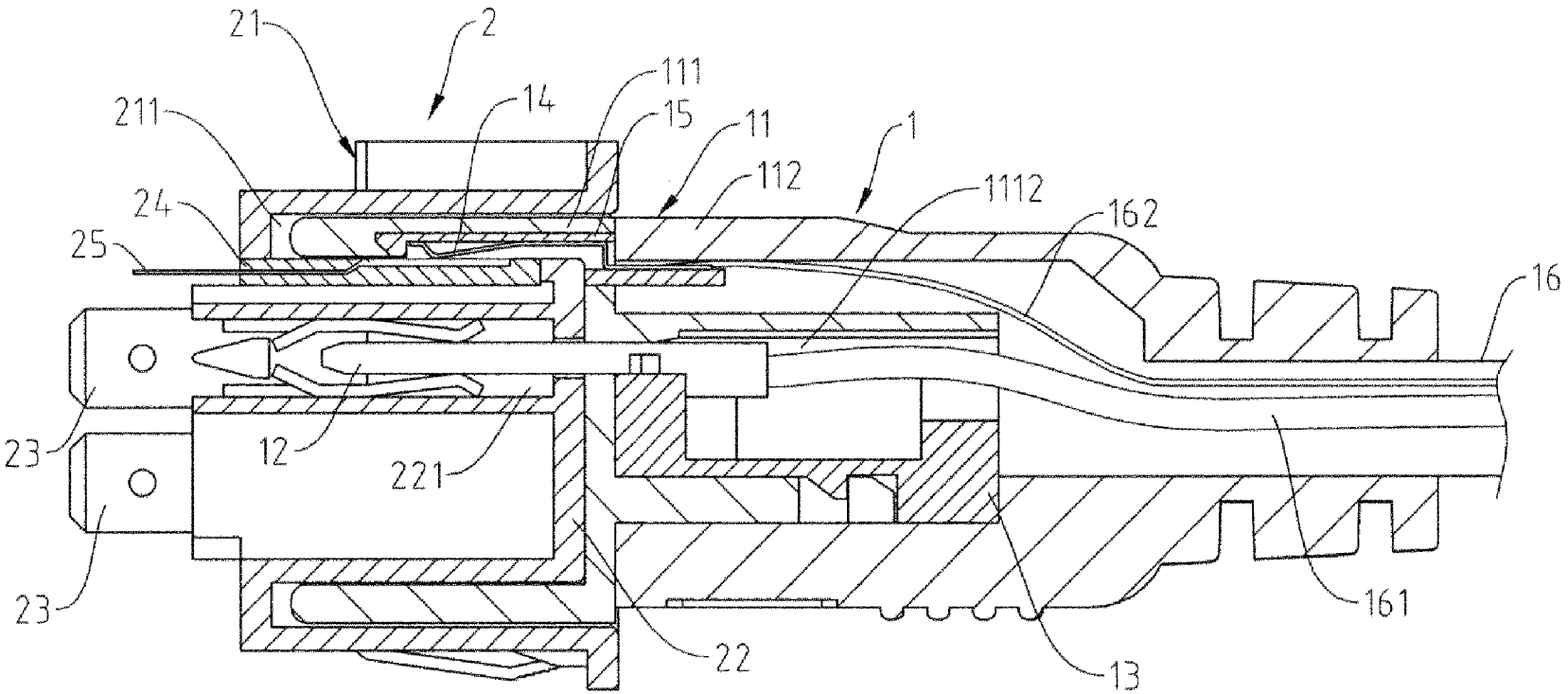
FIG. 6 corresponds to FIG. 5, showing the electric plug and the adapter connected together.

Referring to FIGS. 5 and 6, when connecting the electric plug 1 and the adapter 2, insert the electric plug 1 into the adapter 2 to force the front side of the front shell 111 into the receiving chamber 211 of the adapter 2. At this time, the power terminals 12 of the electric plug 1 are respectively inserted into the terminal slots 221 of the electrically insulative core member 22 and respectively electrically forced into contact with the power terminals 23 of the adapter 2 for transmitting electricity. Further, because the signal terminals 14 of the electric plug 1 are respectively suspending in the front receiving chamber 1111, inserting the electric plug 1 into the adapter 2 causes the signal terminals 14 of the electric plug 1 to be forced into contact with the signal terminals 25 of the adapter 2 respectively for signal transmission.

Further, the rear end of the transmission line 16 is electrically connected to a signal source (not shown) and a power source (not shown); the power terminals 23 and signal terminals 25 of the adapter 2 are respectively electrically soldered to a circuit board of an electronic product (not shown).

Further, the signal terminals 14 of the electric plug 1 and the signal terminals 25 of the adapter 2 can be configured subject to RJ45 or USB specifications; the power terminals 12 and 23 can be adapted for transmitting AC power supply or DC power supply.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A combination electric plug assembly, comprising:

an electric plug, said electric plug comprising an electrically insulative housing, the electrically insulative housing of said electric plug comprising a front shell and a rear shell and defining a front receiving chamber in a front side thereof, a set of power terminals mounted in and extending from a bottom side inside said front receiving chamber so as to be suspended within said receiving chamber, and a set of signal terminals mounted in said electrically insulative housing and respectively partially disposed in said front receiving chamber;

an adapter adapted for electrically connecting said electric plug to a circuit board, said adapter comprising an electrically insulative housing, the electrically insulative housing of said adapter defining a receiving chamber adapted for receiving the electrically insulative housing of said electric plug, an electrically insulative core member suspending in the receiving chamber of the electrically insulative housing of said adapter and insertable into the front receiving chamber of the electrically insulative housing of said electric plug, a plurality of terminal slots formed in said electrically insulative core member for receiving the set of power terminals of the electric plug therein, a plurality of power terminals respectively mounted in said terminal slots for the contact of the power terminals of said electric plug respectively, and a set of signal terminals mounted on one side of said electrically insulative core member for the contact of the signal terminals of said electric plug respectively; and a transmission line electrically connected to the power terminals and signal terminals of said electric plug and extending out of a rear side of the electrically insulative housing of said electric plug.

2. The combination electric plug assembly as claimed in claim 1, wherein the electrically insulative housing of said electric plug is comprised of a front shell and a rear shell, said front shell comprising a plurality of rear openings respectively disposed in communication with the front receiving chamber of the electrically insulative housing of said electric plug; said electric plug further comprises a power terminal holder carrying the power terminals of said electric plug and a signal terminal holder carrying the signal terminals of said electric plug, the power terminal holder and signal terminal holder of said electric plug being respectively inserted into the rear openings of said front shell to hold the respective power terminals and the respective signal terminals in the front receiving chamber of the electrically insulative housing of said electric plug.

3. The combination electric plug assembly as claimed in claim 1, wherein said transmission line has a rear side electrically connected to an external signal source and an external power source.

4. The combination electric plug assembly as claimed in claim 1, wherein said transmission line comprises a plurality of power transmission wires respectively electrically connected to the power terminals of said electric plug, and a plurality of signal transmission wires respectively electrically connected to the signal terminals of said electric plug.

5. The combination electric plug assembly as claimed in claim 1, wherein said adapter further comprises a mounting groove formed in one side of said electrically insulative core member, and a signal terminal holder mounted in said mounting groove to hold the signal terminals of said adapter in place.

6. The combination electric plug assembly as claimed in claim 1, wherein the power terminals and signal terminals of said adapter are respectively electrically soldered to a circuit board of an electronic product.

7. The combination electric plug assembly as claimed in claim 1, wherein the signal terminals of said electric plug and the signal terminals of said adapter are configured subject to RJ45 specifications.

8. The combination electric plug assembly as claimed in claim 1, wherein the signal terminals of said electric plug and the signal terminals of said adapter are configured subject to USB (Universal Serial Bus) specifications.

9. The combination electric plug assembly as claimed in claim 1, wherein the power terminals of said electric plug and said adapter are adapted for transmitting AC power supply.

10. The combination electric plug assembly as claimed in claim 1, wherein the power terminals of said electric plug and said adapter are adapted for transmitting DC power supply.

* * * * *